US005589825A

United States Patent [19]

Pomerleau

[11] Patent Number: 5,589,825

[45] Date of Patent: Dec. 31, 1996

[54] LOGGING OR MEASUREMENT WHILE TRIPPING

[75] Inventor: Daniel G. Pomerleau, Calgary, Canada

[73] Assignee: LWT Instruments Inc., Alberta, Canada

[21] Appl. No.: 310,840

[22] Filed: Sep. 22, 1994

[30] Foreign Application Priority Data

Jul. 6, 1994 [CA] Canada ..... 2127476

[51] Int. Cl.[6] ..... G01V 3/00

[52] U.S. Cl. ..... 340/854.9; 340/855.1; 340/855.2; 175/40; 175/50; 175/49

[58] Field of Search ..... 340/854.9, 855.1, 340/855.2; 175/40, 50, 49

[56] References Cited

U.S. PATENT DOCUMENTS

| | | | |
|---|---|---|---|
| 2,719,361 | 10/1955 | Montgomery et al. | 340/854.9 |
| 2,719,362 | 10/1955 | Montgomery et al. | 340/854.9 |
| 2,719,363 | 10/1955 | Montgomery et al. | 340/854.9 |
| 3,800,578 | 4/1974 | Brennan et al. | 72/56 |
| 4,139,836 | 2/1979 | Chaney et al. | 166/208 |
| 4,252,143 | 2/1981 | Fredd | 137/115 |
| 4,254,832 | 3/1981 | Patton et al. | 166/332 |
| 4,320,473 | 4/1982 | Smither et al. | 367/82 |
| 4,508,174 | 4/1985 | Skinner et al. | 166/373 |
| 4,610,005 | 9/1986 | Utasi | 367/33 |
| 4,879,463 | 11/1989 | Wraight et al. | 250/270 |
| 5,010,764 | 4/1991 | Taylor | 73/151 |
| 5,186,255 | 2/1993 | Corey | 166/250 |
| 5,220,963 | 6/1993 | Patton | 175/24 |
| 5,455,573 | 10/1995 | Delatorre | 340/854.8 |

FOREIGN PATENT DOCUMENTS

| | | |
|---|---|---|
| 1098202 | 3/1981 | Canada . |
| 0314573 | 5/1989 | European Pat. Off. . |
| 0449710 | 10/1991 | European Pat. Off. . |

OTHER PUBLICATIONS

Douglas S. Drumheller, Acoustical Properties of Drill Strings—J. Acoust. Soc. Sm. 85(3), Mar. 1989, pp. 1048–1064.

*Primary Examiner*—J. Woodrow Eldred
*Attorney, Agent, or Firm*—David L. Davis

[57] ABSTRACT

A method and apparatus are provided for obtaining measurements from a wellbore during tripping operations. A drilling sub is attached to the drillstring adjacent to or as near as possible to the drillbit before commencing normal drilling operations. Prior to commencing tripping operations, a logging tool is engaged within the drilling sub. The engagement of the logging tool within the drilling sub opens a window mechanism that enables the sensors of the logging tool to obtain data from the wellbore. As tripping operations are conducted, the logging tool obtains data along the length of the wellbore.

34 Claims, 7 Drawing Sheets

LOGGING OR MEASUREMENT WHILE TRIPPING

The present invention relates to a method and device for providing a high resolution picture of a wellbore obtained while tripping drillpipes from a wellbore. The method and apparatus provide a log of the well bore, including a profile of variations in the formation, chemistry and mechanical condition. The method and apparatus can obtain this information while drilling vertical, inclined or horizontal well bores.

BACKGROUND OF THE INVENTION

Information concerning the condition of a borehole is important for the success of the drilling process from both a quality control and planning viewpoint. The information, which comprises many parameters, may be used to warn the engineers of changes in well profile and the stability of the operation. For example, borehole diameters must be carefully controlled during the drilling as they can affect the performance of the downhole assemblies used in directional drilling, restrict the ability of the drilling fluid to remove cuttings from the well and may limit the success of cementing the production casings in place prior to commercial operation of the well. Further, borehole information is used to determine the formation types (lithology) encountered as an indication of the well's potential to produce hydrocarbons. There are many other applications in practice which can use timely wellhole information.

In order to obtain information about the conditions downhole, it is frequently necessary to suspend the drilling process at some specified depths, remove (extract) the drillstring from the wellhole and lower a sensing tool with a collection of sensors at the end of a cable (a wireline telemetering system) into the well. The sensor tool is then slowly withdrawn and the data from the tool is transmitted to the surface up the connecting cable. The information about the well condition is recorded (logged) and subsequently analyzed. This process is known as wireline logging and is capable of producing a tremendous amount of information which the engineers can the use to construct a physical representation of the condition of the well over its entire length.

This type of monitoring has two inherent problems: (1) it relies on gravity for the instrument to descend, and, therefore, if the hole is inclined or has shelf-like steps on the outer surface of the borehole, the instrument may get hung up, and; (2) it does not occur during normal drilling or tripping operations and does not, therefore, provide the driller with real-time or current information on the state of the drilling. Finally, in that drilling operations must be suspended, this method is time-consuming to the well drilling operations and is therefore expensive to undertake.

A second technique of logging while drilling (LWD) involves the positioning a specialized drill collar containing sensing devices near the drill bit. As it is located in the drillstring, it is able access horizontal sections of the wellbore and is not susceptible to hanging up. This technique telemeters information to the surface by acoustical pulses transmitted through the drilling fluid. This technique has been limited in a number of ways: Firstly, it has been limited by the types of drilling fluids that can provide effective acoustical coupling, often limited to drilling fluids such as water, oil or emulsions. Furthermore, as this technique obtains data while the drill bit is rotating (that is, a noisy and vibrating environment), it, typically, has a very slow data transmission rate (1 bit per second) that requires substantial computer processing to compensate for the rotation of the drill bit and artifactual errors.

Furthermore, LWD only collects data immediately behind the drilling bit and does not obtain data from other regions of the borehole. Therefore, if a washout occurs uphole, this technique will not detect it. It therefore becomes necessary to back-up LWD data with wireline logging data. Accordingly, this technique, in addition to requiring expensive LWD equipment further requires the time-consuming technique of wireline logging with additional wireline logging equipment.

A variety of techniques and methods have been used to transfer accumulated data from the sensor tools at the well bottom in the LWD application. One wireless technique transmits information to the surface using acoustic signalling through the drilling fluid (mud) as is called mud pulsing. This kind of telemetry, discussed in Canadian patent 1,098,202, is restricted to certain kinds of drilling fluid which exhibit reasonably low loss transmission. Nevertheless, transmission speeds are low (in the order of one bit per second) due to restricted bandwidth at the sensors and the attenuation constants of the medium. Data compression is used to reduce the number of transmitted bits in an effort to improve the system's performance but this is still fundamentally limited.

Efforts to improve upon the telemetry path by using the drillstring as the medium for acoustic signalling have proven to be only marginally successful. Canadian patent 1,098,202 and U.S. Pat. Nos. 4,139,836 and 4,320,473 have discussed this issue in depth but the technique has failed to gain support in the drilling industry.

SUMMARY OF THE INVENTION

In accordance with the invention, a drilling sub is described for receiving a logging tool through a drillstring, the logging tool having sensing and monitoring devices for collecting and storing data from within the drillstring, the drilling sub comprising:

a body engageable with the drillstring;

coupling means within the body for engaging the logging tool within the body;

window means on the body to enable the sensing and monitoring means access to the well bore.

In other embodiments of the invention, the window means may be a hydraulically actuated window responsive to the engagement of the logging tool within the drilling sub, open slots in the body of the drilling sub, a thin wall section of the body or a sliding sleeve within the body.

In one specific embodiment, the window sleeve is further provided with a sleeve latching mechanism for locking the sleeve in a closed position and a logging tool latching mechanism for locking the logging tool against the window sleeve.

In another embodiment of the invention, the body of the drilling sub is provided with a landing section and an upper section, the landing and upper sections having an internal bore and having threaded surfaces for respective attachment/detachment of the landing and upper sections to/from one another.

In a specific embodiment, the invention provides a drilling sub for receiving a logging tool through a drillstring, the logging tool having sensing and monitoring means for collecting and storing data from within the drillstring, the drilling sub comprising:

a cylindrical body for engagement with a drillstring, the body forming a section of the drillstring, the body having a landing section and an upper section, the landing and upper sections having an internal bore and having threaded surfaces for respective attachment/detachment of the landing and upper sections to/from one another;

coupling means on the body for engaging and orienting the logging tool within the drillstring;

window means having at least one open channel between the outer and inner surfaces of the body;

a window sleeve slidably engaged with the inner surface of the body, the window sleeve moveable between an open position wherein the open channel is uncovered and a closed position wherein the open channel is covered;

sleeve latching mechanism for locking the sleeve in the closed position and logging tool latching mechanism for locking the logging tool against the window sleeve.

The invention also provides a logging tool for collecting data from a wellbore during drilling and tripping operations from within a downhole drillstring and associated drillbit. The logging tool comprises:

a body adapted for movement through a drillstring;

engagement means on the body for engaging and locking the logging tool adjacent the drillbit;

sensors within the body for collecting data from the wellbore;

computer means within the body having control means for activating and controlling the sensors and memory means for storing data from the sensors, the computer means having power means for providing power to the sensors and control means.

The logging tool sensors may be selected from but are not limited to drillstring movement sensing means, gamma ray sensing means, acoustic pulse generators and receivers, pressure sensing means, temperature sensing means, resistivity sensing means, potential sensing means and borehole direction sensing means.

In one embodiment, the logging tool is provided with cable connection means for connecting the logging tool to a cable for lowering and/or retrieving the logging tool into/from the drillstring.

In a specific embodiment, the logging tool comprises:

a cylindrical body adapted for movement through a drillstring;

a mule shoe guide on the body for engaging, locking and orienting the logging tool within the drillstring adjacent the drillbit;

sensors within the body for collecting data from the wellbore, the sensors selected from at least one of a direction sensing means, gamma ray sensing means, acoustic pulse generators and receivers, borehole caliper sensing means, pressure sensing means, temperature sensing means, and borehole direction sensing means;

computer means within the body with associated control means, memory means and batteries for activating and controlling the sensors and for storing data from the sensors;

cable connection means for connecting the logging tool to a cable for lowering and/or retrieving the logging tool into/from the drillstring.

In another embodiment of the invention, the invention provides a surface data acquisition system for receiving data from the logging tool, comprising:

drillstring position tracking means for tracking the downhole depth of the logging tool and drillstring;

memory means for storing the downhole depth of the logging tool and drillstring;

synchronizing means for synchronizing the drillstring position tracking means with the sensing and monitoring means;

status check means for determining the status of the logging tool sensors and memory;

control means for initiating or delaying the data collection by the logging tool;

The invention also provides a method for collecting data from a wellbore with a downhole drillstring and associated drillbit during drilling and tripping operations, comprising the steps of:

a) attaching a drilling sub to the drillstring behind and adjacent the drilling bit prior to drilling operations;

b) lowering and/or pumping a logging tool down the drillstring prior to tripping operations;

c) engaging and orienting the logging tool within the drilling sub;

d) activating the logging tool for collecting and storing data from the borehole as tripping operations are initiated;

e) collecting and storing borehole data during tripping operations;

f) monitoring the downhole depth of the drillstring during tripping operations;

In another embodiment, the method further comprises correlating the stored borehole data with the downhole depth of the drillstring.

In still another embodiment, the initiation of logging tool data collection is responsive to a direction sensing means in the logging tool detecting uphole movement of the drillstring.

In a still further embodiment of the invention, the invention provides a data acquisition system for collecting data from a wellbore with a downhole drillstring and associated drillbit during drilling and tripping operations, the system comprising:

a drilling sub integral with the drillstring adjacent the drillbit and a logging tool for collecting data from the wellbore, the logging tool adapted for movement through the drillstring and for engagement with the drilling sub, the logging tool with sensor means, control means and memory means for collecting and storing data from the wellbore during tripping operations, the drilling sub with window means for providing the sensor means access to the wellbore from within the bore of the drillstring.

In a still further embodiment, the data acquisition system further comprises a surface computer means for monitoring the depth of the drillstring during tripping operations and for receiving data from the logging tool following tripping operations.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
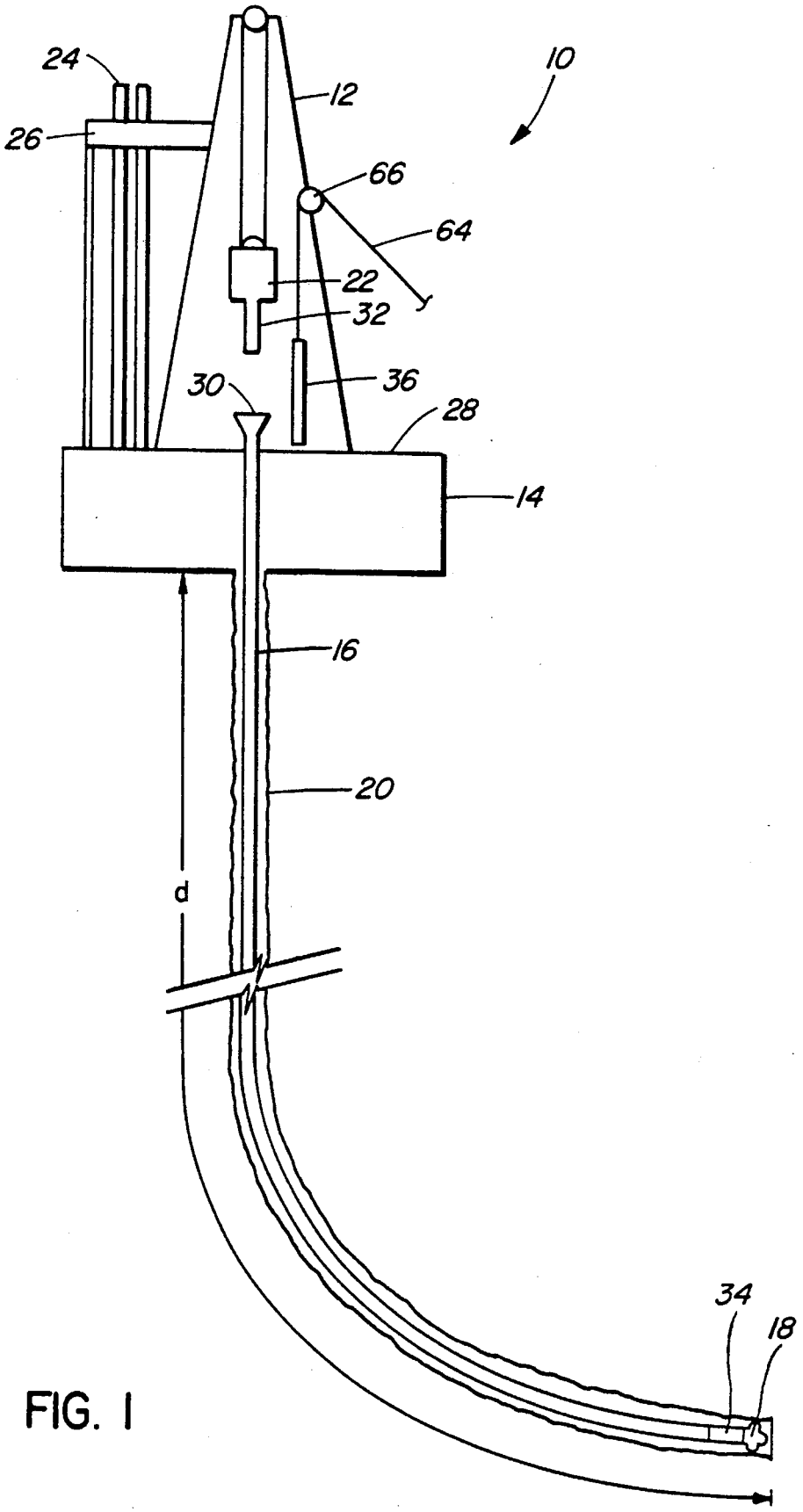
FIG. 1 is a schematic diagram of a drilling rig and borehole with the drilling sub and logging tool in accordance with the invention.

A typical drilling rig 10 is shown in FIG. 1. The drilling rig 10 is provided with a derrick 12 on a drilling platform 14. During normal drilling operations, a drillstring 16 with drill bit 18 drills borehole 20 in a conventional manner. During drilling circulating head 22 maintains a flow of drilling fluid within the borehole 20 to effect removal of debris and maintain lubrication. As the borehole 20 is progressed, further drill pipes 24 are removed from rack 26 and attached to the drillstring 16.

The cycling of drill pipes 24 in and out of the drill hole 20 is required on a regular basis for reasons, amongst others, to replace worn drilling bits, to adjust/alter/change the types or locations of pipes 24 in the drillstring 16, or simply to remove the pipes 24 from the hole 20. During this cycle, the drill pipes 24 are removed from the borehole 20 in sections ranging from approximately 90 feet to as little as 30 feet depending on the type of drilling rig 10 employed. These sections of drill pipe 24, called "stands" are removed at a steady and continuous rate or velocity during the interval covering their length. As each stand 24 is removed from the well, the pipe movement is suspended while the stand is recoupled/separated from the drillstring (which consists of pipe yet to be drawn out of the well) and stood back in the drilling derrick 12, by a procedure known as "racking back". During this tripping cycle, a series of cable hooks and "bales" (not shown) is moved continuously from the floor 28 of the drilling rig 10 (which is a working platform set about 30 to 50 feet above the ground level) where the bales are hooked onto the drillpipe 24, to the top of the derrick 12 (50–100 feet above the floor 28) where the derrick man releases the bales (after ensuring that the recoupled base of the stand 24 has been located on the drilling floor 28 away from the top of the exposed top 30 of the drilling string 16) prior to racking back the stand 24. The bales are then returned to the floor 28 where the cycle continues, a total cycle time of approximately 3–5 minutes depending on the length of the stand.

With reference to FIGS. 1–5, logging measurements in accordance with the invention may be made at the time of commencing normal tripping operations with drilling sub 34 and logging tool 36. Prior to the commencement of drilling operations, a drilling sub is attached to and forms pan of the drillstring 16 immediately adjacent or as close as possible to the drill bit 18. The drilling sub 34 would typically be a specialized section of drillpipe 24 with window channels 38 in the wall of the drill pipe 24 between the bore 39 of the drillpipe 24 and the wellbore 20 as shown schematically in FIG. 2 and FIG. 4. Alternatively, the window channels 38 of the drilling sub may be represented as thin wall sections of the drillpipe 24 wall sufficiently thin to enable logging tool 36 sensors access to the well bore 20 as shown in FIGS. 3, 3*a*, 3*b*, and 3*c*.

In the particular embodiment of the drilling sub 34 and assembly shown in FIGS. 3, 3*a*, 3*b*, and 3*c*, the drilling sub 34 comprises a landing section 80, an upper section 82, a thread seal 84 and a landing shoe 86. Logging tool 36 is shown to engage within the assembled drilling sub 34 with landing shoe 86. The landing section 80 has a threaded section 88 for attachment of a drillbit 18 or another drillstring section 16. The upper portion of the landing section 80 is also provided with a threaded section 90 for receiving the mating threads 92 of the upper section 82. Similarly the upper portion of the upper section 82 is provided with threads 94 for engagement with a drillstring section 16. Accordingly, landing section 80 and upper section 82 are screw-connected together. Thread seal 84 is seated between the two sections to seal against fluid loss through the threaded sections 90 and 92. Logging tool seating device or mule shoe 86, located in the lower region of the landing section 86, enables seating and alignment of the logging tool 36 within the drilling sub 34.

Figure 2:
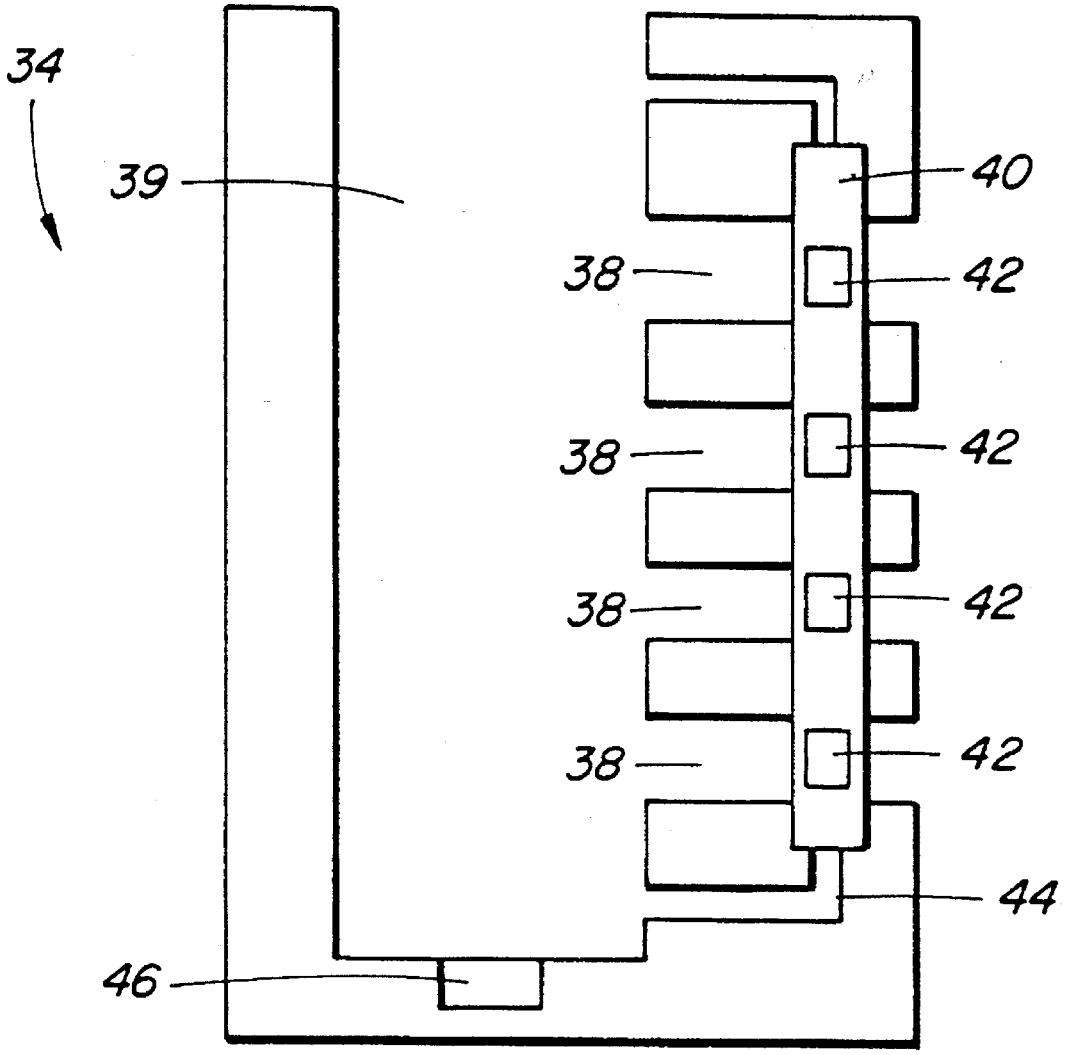
FIG. 2 is a schematic diagram of the drilling sub.
Figure 3:
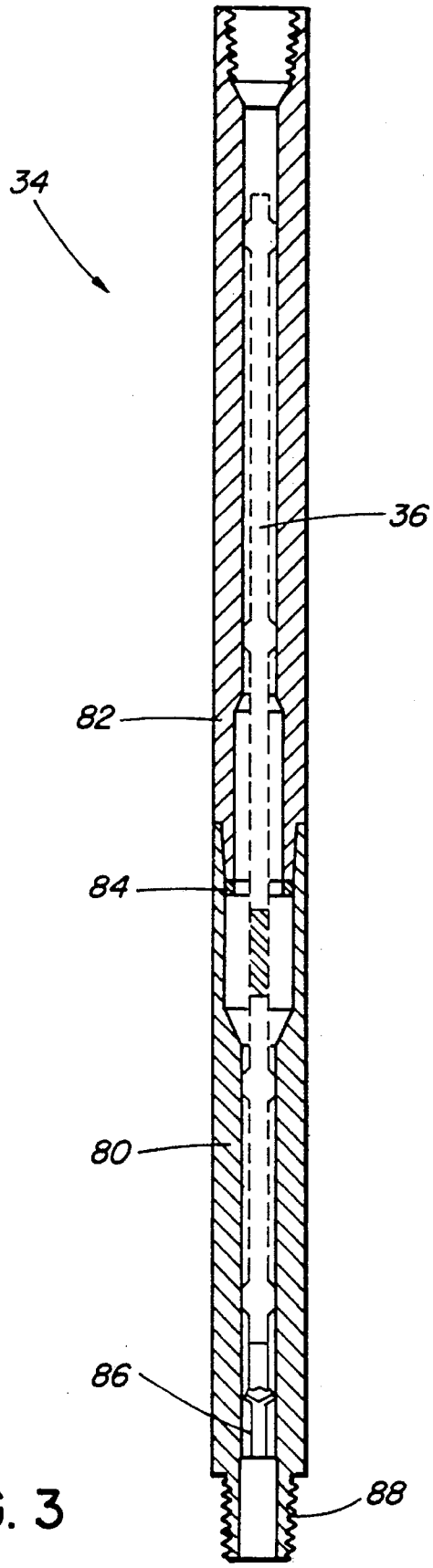
FIG. 3 is a cross-section of an assembled drilling sub.
Figure 3A:
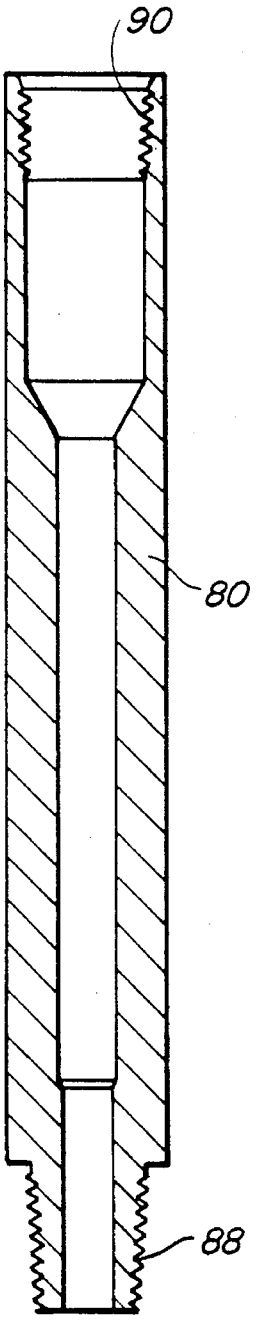
FIG. 3*a* is a cross-section of the upper section of a drilling sub.
Figure 3B:
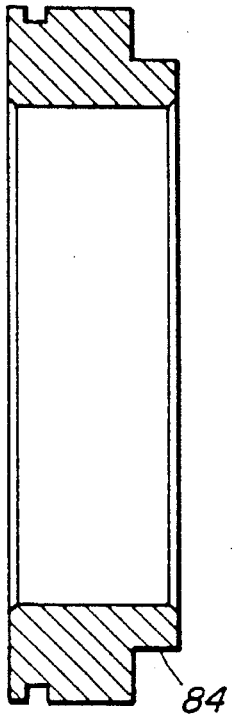
FIG. 3*b* is a cross-section of a thread seal ring of a drilling sub.
Figure 3C:
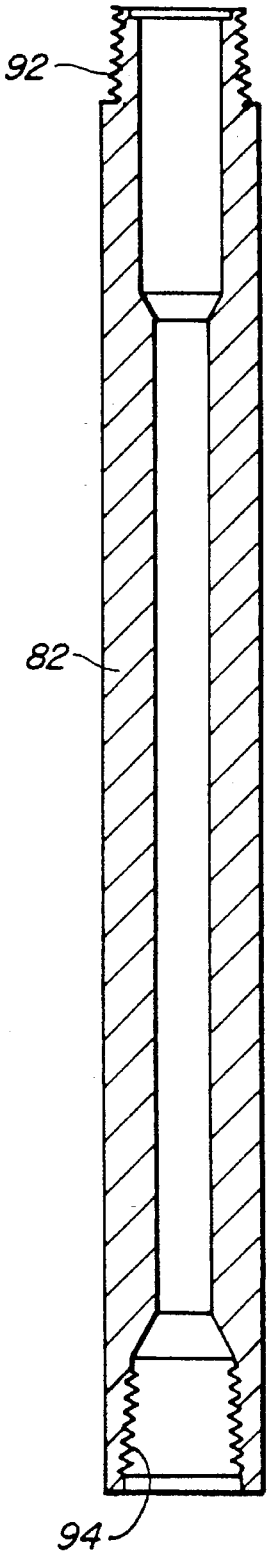
FIG. 3*c* is a cross-section of landing section of a drilling sub.

The window channels 38 may be provided with a window mechanism 40, hydraulically actuated in response to a logging tool 36 seating within the drilling sub 36. The window mechanism 40 is provided with windows 42 which are rotated to open the window channels 38 to enable logging tool 36 sensors access to the well bore 20. Hydraulic actuation may be provided through pressure tubes 44 (FIG. 2).

Figure 4:
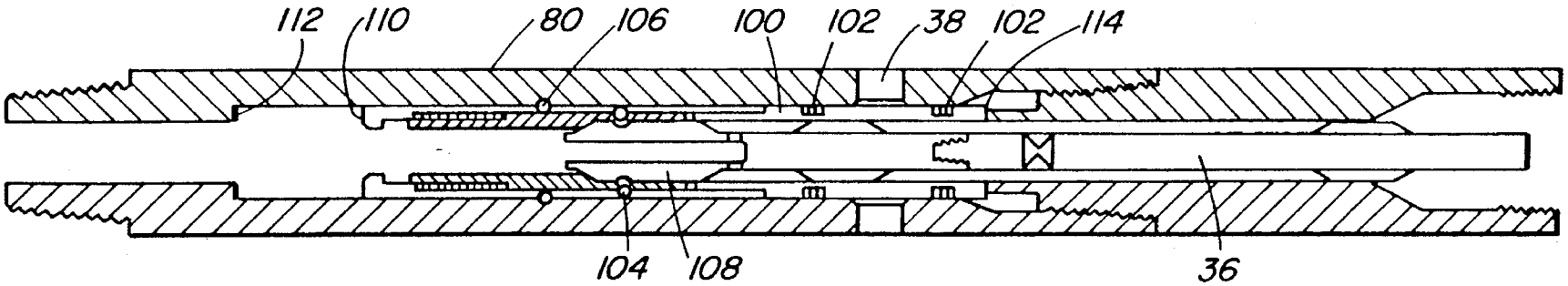
FIGS. 4 and 4A are schematic diagrams of an embodiment of the window opening mechanism in the open and closed positions.
Figure 4A:
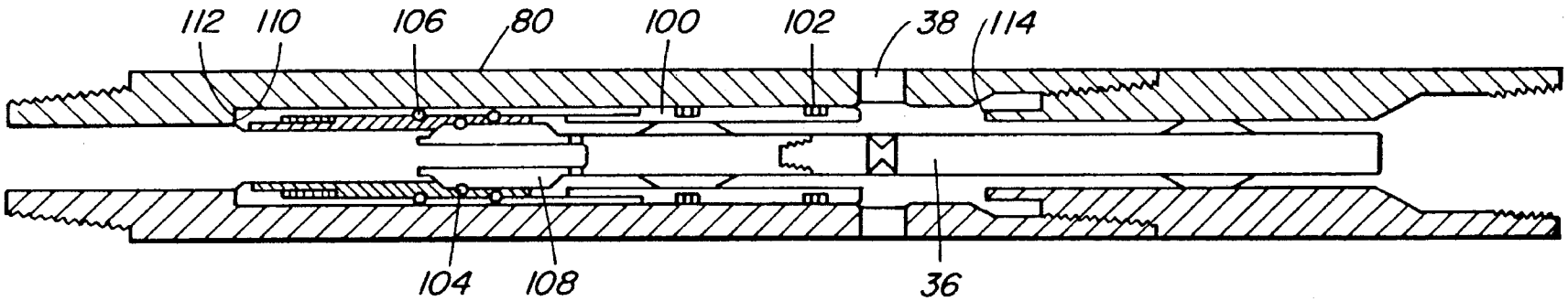

In an embodiment of the window mechanism as shown in FIG. 4, the window mechanism comprises a sliding sleeve 100 on bearings 102. The sleeve 100 has latching mechanism 104 for latching the logging tool 36 onto the sleeve 100. Sleeve locking mechanism 106 is provided to lock the sleeve 100 in the closed position.

In operation, the logging tool 36 enters the drilling sub 34. The landing shoe section 108 of logging tool 36 engages and locks with latching mechanism 104. As logging tool 36 is pushed further into the drilling sub 34, the sleeve 100 is pushed along the landing section 80, disengaging sleeve locking mechanism 106. The sleeve 100 slides along the landing section 80 until front edge 100 of the sleeve 100 engages against surface 112, thereby withdrawing sleeve 100 from window 38.

The window 38 is closed by removal of the logging tool 36 from the drilling sub 34. As logging tool 36 is withdrawn, sleeve 100 slides to close window 38. As sleeve 100 engages against edge 114, sleeve locking mechanism 106 is re-engaged to lock the sleeve 100 in the closed position. Further withdrawal of the logging tool 36 disengages the latching mechanism 104 from the logging tool 36.

It is understood that other window mechanisms on the drilling sub 34 may be designed in accordance with the invention.

Figure 5:
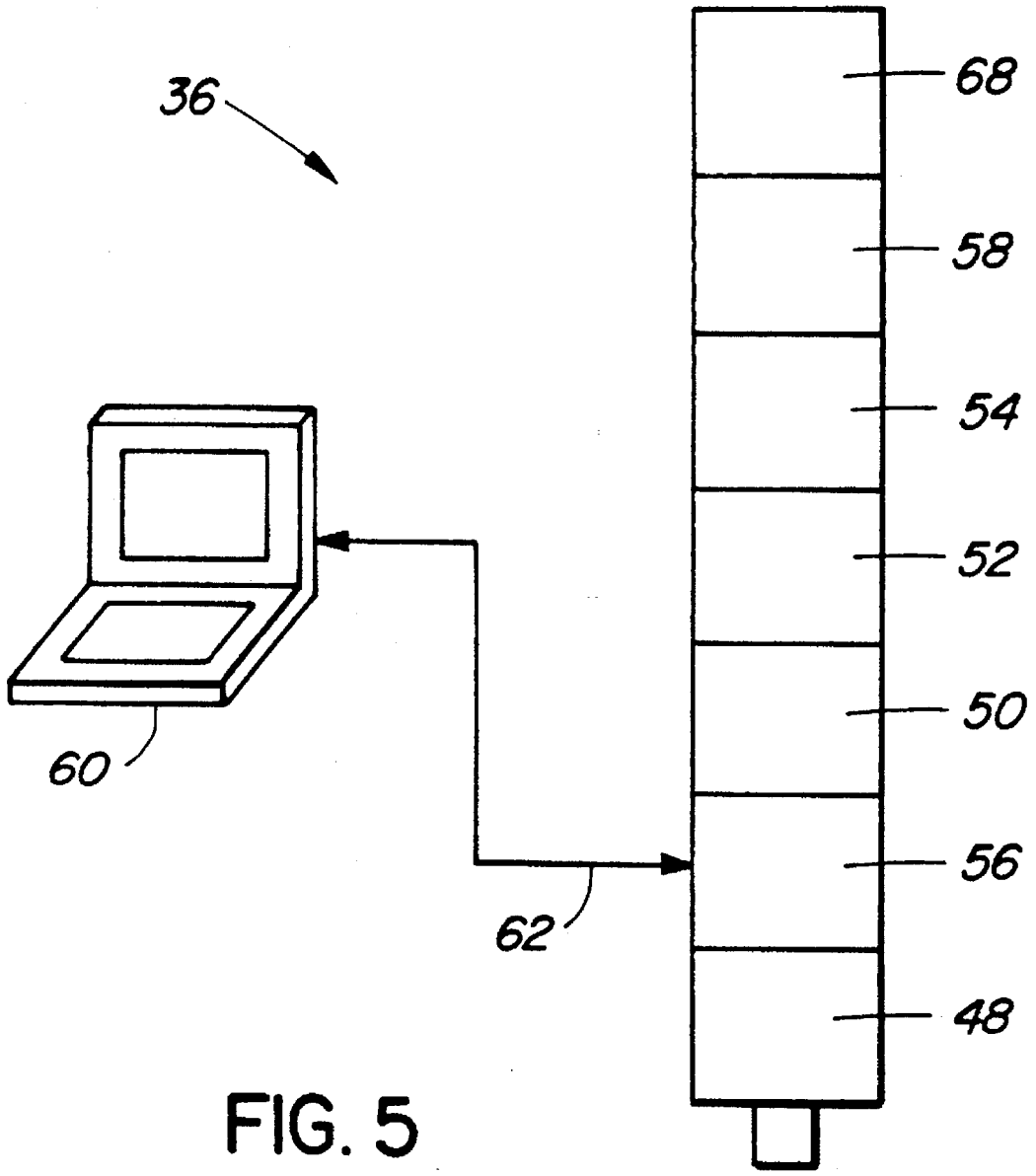
FIG. 5 is a schematic diagram of the logging tool.

The logging tool 36 is provided with a series of sensors including but not limited to direction sensor 50, a gamma ray sensor 52 and acoustic pulse generators and receivers 54 shown schematically in FIG. 5. The direction sensor 50 may be used to determine the relative direction of movement of the drillstring 16 at a given time, that is, either up hole or down hole. The gamma ray sensor 52 may detect the natural gamma ray emissions within the rock formation for characterization of the lithology and acoustic pulse generator and receivers may be used for detecting the diameter of the borehole 20 and the lithology and porosity. The sensors are connected to computer 56 which receives power from batteries 58. The computer 56 may activate the associated sensors at a given time, t, and thereafter receive and store data received from the sensors. Alternatively, the sensors may be activated in response to a drillstring movement sensor 50.

Other sensors or transducers may include but are not limited to devices for measuring drillstring movement, gamma ray emissions, pressure, temperature, resistivity, natural potential (DC voltage) and the borehole direction. Sensors may be emitting and receiving devices or receive-only devices.

Figure 6:
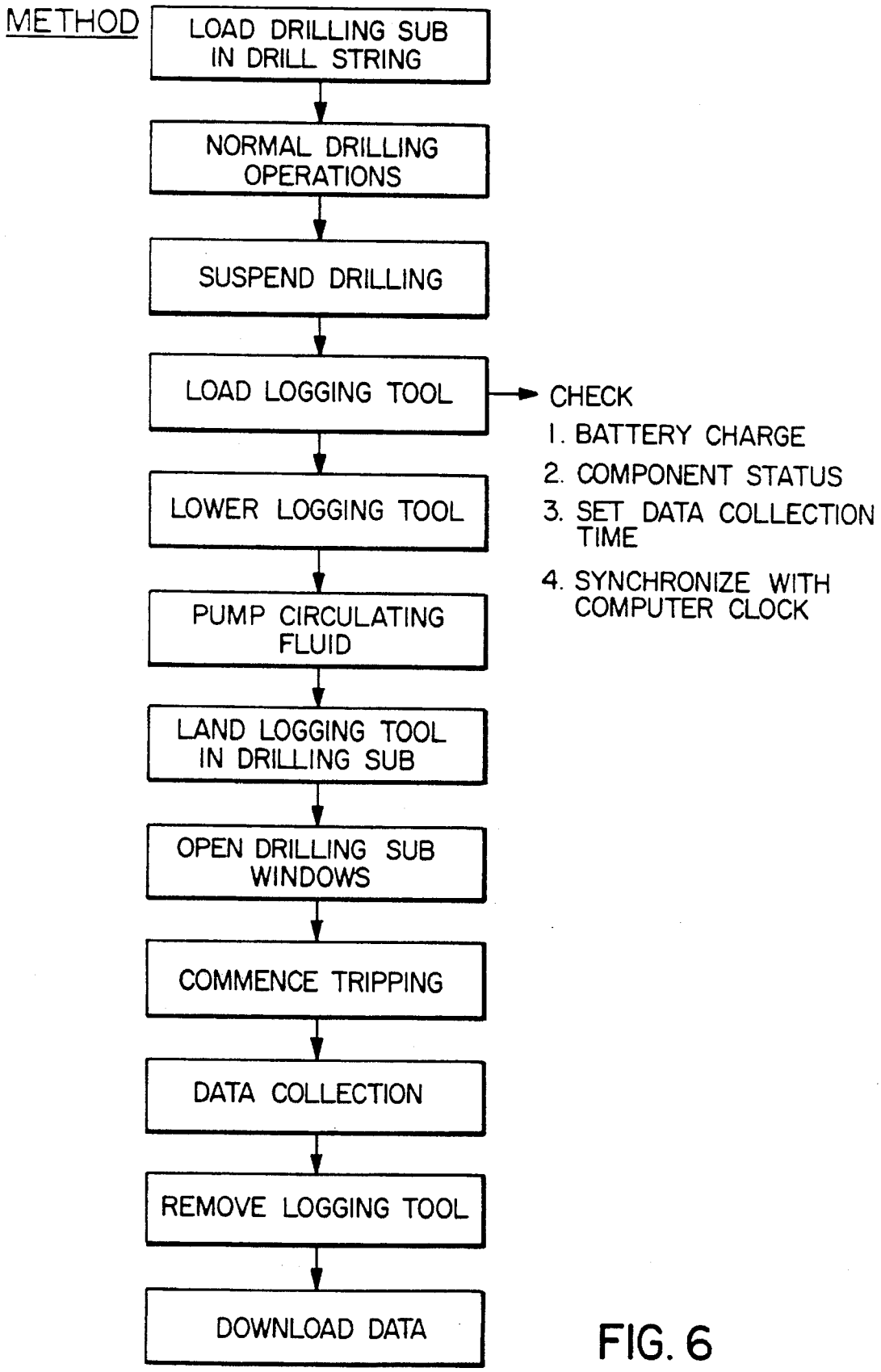
FIG. 6 is a block diagram of the method of the invention.

In acquiring data from the borehole 20, the following procedure is conducted to obtain a log of the physical characteristics of the borehole correlated to the depth of the borehole (FIG. 6).

At the time of initiating normal drilling operations, the drilling sub 34 is attached to and made a part of the drillstring 16 immediately behind or as close as possible to the drill bit 18. Normal drilling operations are conducted until a wellbore 20 depth, d, is obtained and tripping operations are required to bring the drill bit 18 to the surface.

Drilling operations are suspended and the circulating head 22 is removed from the drillstring 16 and lifted from joint 30. The logging tool 36 is prepared for insertion into the drillstring 16 and checked by surface computer 60 connected to the logging tool 36 by serial link 62. The surface computer 60 checks the state of charge of the batteries 58, sensor status, synchronizes the time-clocks of the onboard computer 56 with that of the surface computer 60, and in one embodiment, sets a time, t, at for the initiation of data collection.

After the surface checks and synchronization is complete, the logging tool 36 may be seated in drilling sub 34 by two different methods.

In the first embodiment, the logging tool is lowered into the drillstring 16 by cable 64 and pulley 66 attached to cable connection and release mechanism 68 on the uphole end of the logging tool 36. The cable connection and release mechanism 68 is for lowering the logging tool 36 into the drillstring 16 and for the releasing the cable 64 from the logging tool 36. Lowering the logging tool down the drillstring 16 may require sinker bars (not shown) to provide added weight to the logging tool 36.

In another embodiment, the logging tool is placed in the drillstring 16 and the circulating head 22 is reattached to the drillstring 16. A circulation of drilling fluid is commenced until the logging tool 36 reaches its landing point on the drilling sub 34. By moving the logging tool 36 into position by pumping drilling fluid, it is possible for the logging tool to access horizontal regions of the drillstring 16 as shown in FIG. 1. The circulating head operator will detect an increase in pressure when the logging tool 36 reaches its landing point within the drilling sub 34 and logging tool connection device 48 seats within drilling sub connection device 46. In the embodiment of the drilling sub 34 provided with hydraulically activated windows 42, the pressure build-up, acting through pressure tubes 44 will actuate windowing mechanism 40, in order that windows 42 provide access of the logging tool sensors to the well bore 20. In both the sliding sleeve and hydraulic embodiments of the windowing mechanism, the surface operator will detect a decrease in pressure signalling that the windows are open and that tripping operations may begin by removal of drillstrings 16 from the borehole 20 in a conventional manner.

The signal for the collection of data may be a fixed time set between the surface computer 62 and the onboard computer 56 or may be signalled by direction sensor 50 actuated by the initial uphole movement of the drillstring 16 as tripping operations are commenced. In either event, as the drillstring 16 is moved uphole, data from the logging tool sensors will be stored in the onboard computer 56 as a function of time. At the same time, the surface computer 60 monitors the depth of the logging tool 36 by recording the amount of pipe removed from the borehole 20 at any time, t, and subtracting this value from the absolute depth of the borehole, d. This tracking can be done in numerous ways as may be understood by those skilled in the art.

After the entire drillstring 16 has been removed from the borehole 20, the logging tool may be recovered from the drilling sub 34 and reattached to surface computer 60 via serial link 62. Data stored within onboard computer 56 may be downloaded to surface computer 60 and consolidated with the depth of the drillstring 16 as a function of time to provide a log of the wellbore 20.

Alternatively, if the entire drillstring 16 need not be removed but it is desirable to remove the logging tool 36 to download data, the logging tool may be recovered from the drilling sub 34 by an "overshot" device (not shown), well known to those skilled in the art.

Data consolidation at the surface will merge the downhole data vs. time readings from the logging tool 36 with the depth vs. time data from the surface acquisition system to provide the desired downhole data vs. depth data.

The terms and expressions used in this description are intended for purposes of illustration and it is understood that variations may be made without departing from the spirit and scope of the invention.

What is claimed is:

1. A drilling sub for receiving a logging tool through a drillstring, the logging tool having sensing and monitoring means for collecting and storing data from within a drillstring, the drilling sub comprising:

a drilling sub body engageable with the drillstring;

coupling means within the drilling sub body for engaging the logging tool within the drilling sub body; and hydraulically actuated window means on the drilling sub body responsive to the engagement of the logging tool within the drilling sub body, the window means to enable the sensing and monitoring means access to the well bore.

2. The drilling sub as in claim 1 wherein the coupling means further comprises alignment means for orienting the sensing and monitoring means in relation to the window means.

3. A drilling sub for receiving a logging tool through a drillstring, the logging tool having sensing and monitoring means for collecting and storing data from within the drillstring, the drilling sub comprising:

a drilling sub body engagable with the drillstring;

coupling means within the drilling sub body for engaging the logging tool within the drilling sub body; and window means on the drilling sub body to enable the sensing and monitoring means access to the well bore, wherein the window means is a thin wall section of the body.

4. The drilling sub as in claim 1 wherein the drilling sub body is a hollow cylinder having threaded surfaces for engagement with the drillstring, the drilling sub body forming a section of the drillstring and where the window means comprises:

at least one open channel between the outer and inner surfaces of the drilling sub body; and a window sleeve slidably engaged with the inner surface of the drilling sub body, the window sleeve moveable between an open position wherein the at least one open channel is uncovered and a closed position wherein the at least one open channel is covered.

5. The drilling sub as in claim 4 wherein the window sleeve is provided with a sleeve latching mechanism for locking the sleeve in the closed position and a logging tool latching mechanism for locking the logging tool against the window sleeve.

6. The drilling sub as in claim 1 wherein the drilling sub body includes:

a landing section and an upper section, the landing and upper sections having an internal bore and having threaded surfaces for respective attachment/detachment of the landing and upper sections to/from one another.

7. A drilling sub for receiving a logging tool through a drillstring, the logging tool having sensing and monitoring means for collecting and storing data from within the drillstring, the drilling sub comprising:

a drilling sub body for engagement with the drillstring, the drilling sub body forming a section of the drillstring, the drilling sub body having a landing section and an upper section, the landing and upper sections having an internal bore and having threaded surfaces for respective attachment/detachment of the landing and upper sections to/from one another;

coupling means on the drilling sub body for engaging and orienting the logging tool within the drilling sub body;

window means having at least one open channel between the outer and inner surfaces of the drilling sub body;

a window sleeve slidably engaged with the inner surface of the drilling sub body, the window sleeve movable between an open position wherein the at least one open channel is uncovered and a closed position wherein the at least one open channel is covered;

a sleeve latching mechanism for locking the sleeve in the closed position; and a logging tool latching mechanism for locking the logging tool against the window sleeve.

8. A logging tool for collecting data from a wellbore during drilling and tripping operations from within a downhole drillstring and associated drillbit, the logging tool comprising:

a logging tool body adapted for movement through the drillstring;

engagement means on the logging tool body for engaging and locking the logging tool with a drilling sub;

sensors and memory means within the logging tool body for collecting and storing data from the wellbore; and computer means within the logging tool body having control means for activating and controlling the sensors and memory means for storing data from the sensors, the computer means having power means within the logging tool body for providing power to the sensors and computer means.

9. The logging tool as claimed in claim 8 wherein the sensors are selected from at least one of a drillstring movement sensing means, gamma ray sensing means, acoustic pulse generators and receivers, pressure sensing means, temperature sensing means, resistivity sensing means, potential sensing means and borehole direction sensing means.

10. The logging tool as claimed in claim 8 further comprising cable connection means for connecting the logging tool to a cable for lowering and/or retrieving the logging tool into/from the drillstring.

11. The logging tool as claimed in claim 8 further comprising a mule shoe guide.

12. The logging tool as claimed in claim 8 wherein the power means are batteries.

13. A logging tool for collecting data from a wellbore during drilling and tripping operations from within a downhole drillstring and associated drillbit, the logging tool comprising:

a cylindrical body adapted for movement through the drillstring;

a mule shoe guide on the cylindrical body for engaging, locking and orienting the logging tool within the drillstring adjacent the drillbit;

at least one sensor within the cylindrical body for collecting data from the wellbore, the at least one sensor selected from the group consisting of a direction sensing means, gamma ray sensing means, acoustic pulse generators and receivers, borehole caliper sensing means, pressure sensing means, temperature sensing means, and borehole direction sensing means;

computer means within the cylindrical body with associated control means, memory means and batteries for activating and controlling the at least one sensor and for storing data from the at least one sensor; and cable connection means for connecting the logging tool to a cable for lowering and/or retrieving the logging tool into/from the drillstring.

14. A method for collecting data from a wellbore with a downhole drillstring and associated drillbit during drilling and tripping operations, the method comprising the steps of:

a) attaching a drilling sub to the drillstring behind and adjacent the drilling bit prior to drilling operations;

b) lowering and/or pumping a logging tool down the drillstring prior to tripping operations;

c) engaging and orienting the logging tool within the drilling sub;

d) activating the logging tool for collecting and storing data from the borehole as tripping operations are initiated;

e) collecting and storing borehole data during tripping operations;

f) monitoring the downhole depth of the drillstring during tripping operations.

15. The method as in claim 14 further comprising correlating the stored borehole data with the downhole depth of the drillstring.

16. The method as in claim 14 wherein initiation of logging tool data collection is responsive to a direction sensing means in the logging tool detecting uphole movement of the drillstring.

17. A data acquisition system for collecting data from a wellbore with a downhole drillstring and associated drillbit during drilling and tripping operations, the system comprising:

a drilling sub integral with the drillstring adjacent the drillbit and a logging tool for collecting data from the wellbore, the logging tool adapted for movement through the drillstring and for engagement with the drilling sub, the logging tool for collecting and storing data from the wellbore during tripping operations, the drilling sub with window means for providing logging tool access to the wellbore from within the drillstring.

18. The system as claimed in claim 17 further comprising surface computer means for monitoring the depth of the drillstring during tripping operations and for receiving data from the logging tool following tripping operations.

19. A data acquisition system as in claim 17 wherein the drilling sub comprises:

a drilling sub body engageable with the drillstring; and coupling means within said drilling sub body for engaging the logging tool within the drilling sub body.

20. A data acquisition system as in claim 17 wherein the window means comprises a hydraulically actuated window responsive to the engagement of the logging tool within the drilling sub.

21. A data acquisition system as in claim 19 wherein the coupling means further comprises alignment means for orienting the sensing and monitoring means in relation to the window means.

22. A data acquisition system as in claim 17 wherein the window means are one or more open slots.

23. A data acquisition system as in claim 17 wherein the window means is a thin wall section of the drilling sub body.

24. A data acquisition system as in claim 19 wherein the drilling sub body is a hollow cylinder having threaded surfaces for engagement with the drillstring, the drilling sub body forming a section of the drillstring and where the window means comprises:

at least one open channel between the outer and inner surfaces of the drilling sub body; and a window sleeve slidably engaged with the inner surface of the drilling sub body, the window sleeve movable between an open position wherein the at least one open channel is uncovered and a closed position wherein the at least one open channel is covered.

25. A data acquisition system as in claim 24 wherein the window sleeve is provided with a sleeve latching mechanism for locking the sleeve in the closed position and a logging tool latching mechanism for locking the logging tool against the window sleeve.

26. A data acquisition system as in claim 17 wherein the drilling sub body includes:

a landing section and an upper section, the landing and upper sections having an internal bore and having threaded surfaces for respective attachment/detachment of the landing and upper sections to/from one another.

27. A data acquisition system as in claim 17 wherein the drilling sub comprises:

a drilling sub body for engagement with the drillstring, the drilling sub body forming a section of the drillstring, the drilling sub body having a landing section and an upper section, the landing and upper sections having an internal bore and having threaded surfaces for respective attachment/detachment of the landing and upper sections to/from one another;

coupling means on the drilling sub body for engaging and orienting the logging tool within the drilling sub body;

window means having at least one open channel between the outer and inner surfaces of the drilling sub body;

a window sleeve slidably engaged with the inner surface of the drilling sub body, the window sleeve movable between an open position wherein the at least one open channel is uncovered and a closed position wherein the at least one open channel is covered;

a sleeve latching mechanism for locking the sleeve in the closed position; and a logging tool latching mechanism for locking the logging tool against the window sleeve.

28. A data acquisition system as in claim 17 wherein the logging tool comprises:

a logging tool body adapted for movement through the drillstring;

engagement means on the logging tool body for engaging and locking the logging tool with the drilling sub;

sensors and memory means within the logging tool body for collecting and storing data from the wellbore; and computer means within the logging tool body having control means for activating and controlling the sensors and memory means for storing data from the sensors, the computer means having power means within the logging tool body for providing power to the sensors and computer means.

29. A data acquisition system as in claim 28 wherein the sensors are selected from the group consisting of a drillstring movement sensing means, gamma ray sensing means, acoustic pulse generators and receivers, pressure sensing means, temperature sensing means, resistivity sensing means, potential sensing means and borehole direction sensing means.

30. A data acquisition system as in claim 17 further comprising cable connection means for connecting the logging tool to a cable for lowering and/or retrieving the logging tool into/from the drillstring.

31. A data acquisition system as in claim 19 wherein the coupling means is a mule shoe guide.

32. A data acquisition system as in claim 28 wherein the power means are batteries.

33. A data acquisition system as in claim 17 wherein the logging tool comprises:

a cylindrical body adapted for movement through the drillstring;

a mule shoe guide on the cylindrical body for engaging locking and orienting the logging tool within the drilling sub;

at least one sensor within the cylindrical body for collecting data from the wellbore, the at least one sensor selected from the group consisting of a direction sensing means gamma ray sensing means, acoustic pulse generators and receivers, borehole caliper sensing means, pressure sensing means, temperature sensing means, and borehole direction sensing means;

computer means within the cylindrical body with associated control means, memory means and batteries for activating and controlling the sensors and for storing data from the sensors; and cable connection means for connecting the logging tool to a cable for lowering and/or retrieving the logging tool into/from the drillstring.

34. A data acquisition system as in claim 17 further comprising a surface data acquisition means, the surface data acquisition means including:

drillstring position tracking means for tracking the downhole depth of the logging tool and drillstring;

surface memory means for storing the downhole depth of the logging tool and drillstring;

synchronizing means for synchronizing the drillstring position tracking means with the logging tool;

status check means for determining the status of the logging tool; and surface control means for initiating or delaying the data collection by the logging tool.

* * * * *

UNITED STATES PATENT AND TRADEMARK OFFICE

CERTIFICATE OF CORRECTION

PATENT NO. : 5,589,825
DATED : December 31, 1996
INVENTOR(S) : Daniel G. Pomerleau It is certified that error appears in the above-indentified patent and that said Letters Patent is hereby corrected as shown below:

Column 5, line 39, "recoupled" should be -- decoupled --;

line 49, "recoupled" should be -- decoupled --; and line 60, "pan" should be -- part --.

Signed and Sealed this

Twenty-ninth Day of July, 1997

Bruce Lehman

*Attest:*

BRUCE LEHMAN

*Attesting Officer*

*Commissioner of Patents and Trademarks*